United States Patent [19]

Struss et al.

[11] Patent Number: 4,651,816

[45] Date of Patent: Mar. 24, 1987

[54] HEAT EXCHANGER MODULE FOR A VEHICLE OR THE LIKE

[75] Inventors: Rodney A. Struss, Kenosha; Norman F. Costello; Dennis C. Granetzke, both of Racine, all of Wis.

[73] Assignee: Modine Manufacturing Company, Racine, Wis.

[21] Appl. No.: 841,208

[22] Filed: Mar. 19, 1986

[51] Int. Cl.[4] ..... F28D 7/10

[52] U.S. Cl. ..... 165/76; 165/140; 180/68.4

[58] Field of Search ..... 180/68.4; 165/76, 144, 165/140

[56] References Cited

U.S. PATENT DOCUMENTS

| | | | |
|---|---|---|---|
| 2,505,790 | 5/1950 | Panthofer | 165/144 X |
| 4,137,982 | 2/1979 | Crevis et al. | 180/68.4 |
| 4,367,793 | 1/1983 | MacIntosh | 180/68.4 |

*Primary Examiner*—Albert W. Davis, Jr.
*Assistant Examiner*—Peggy Neils
*Attorney, Agent, or Firm*—Wood, Dalton, Phillip, Mason & Rowe

[57] ABSTRACT

An easily assembled and readily serviceable heat exchanger module particularly suited for vehicular application includes at least two adjacent heat exchangers. At least one of the heat exchangers has a side defined by an outwardly opening channel which in turn receives a plastic bar or strip. The bar is provided with a plurality of relatively deep recesses which are alignable with holes in the channel. The bottoms of the recesses are sufficiently thin as to be easily penetrable by a threaded fastener extending through the holes in the channel and into the recesses for securing components of the module together and yet are sufficiently thick as to prevent the flow of fluid through the recesses to thereby assure that heat exchange fluid will pass through the heat exchangers.

14 Claims, 5 Drawing Figures

FIG. 2
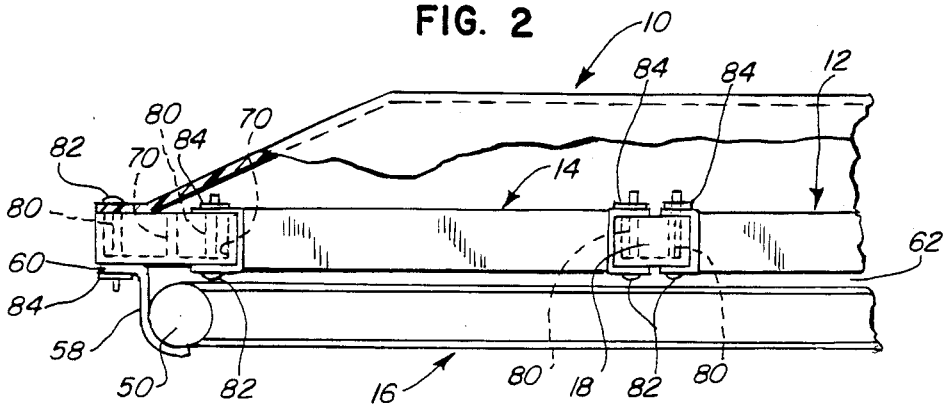
FIG. 3
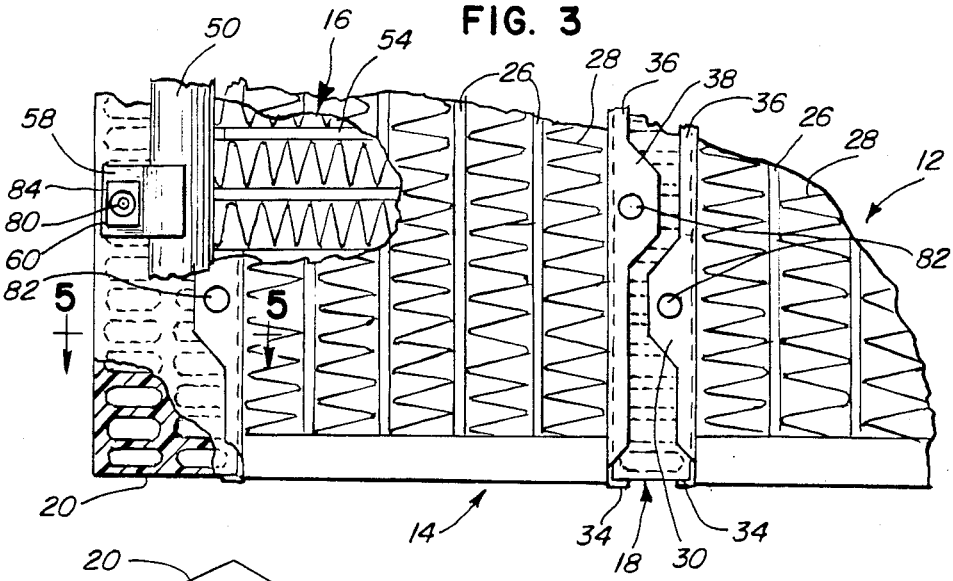
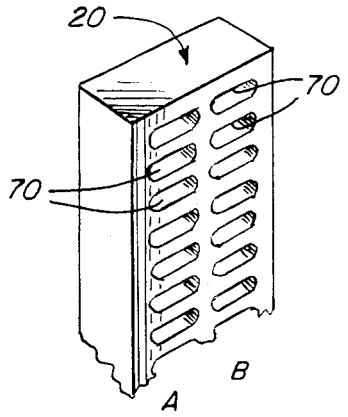
FIG. 4
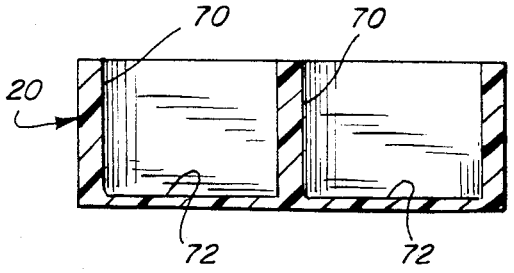
FIG. 5

HEAT EXCHANGER MODULE FOR A VEHICLE OR THE LIKE

FIELD OF THE INVENTION

This invention relates to heat exchangers, and more particularly, to a module of a plurality of heat exchangers as may be used in a vehicle.

BACKGROUND OF THE INVENTION

The last several years has seen an increasing number of heat exchangers employed in vehicles. One heat exchange fluid is the air in which the vehicle is moving which is commonly ducted through a grill or the like to pass through the heat exchanger with assistance from a fan driven either by the engine or by a small electric motor.

In the early days of vehicles, liquid cooled engines required only a single heat exchanger of the type alluded to previously. As is well known, they were commonly termed radiators and were utilized for cooling the liquid coolant for the engine.

As the complexity of vehicles increased, other air cooled heat exchangers were added. Frequently, the provision of an automatic transmission requires a so-called oil cooler as a second form of heat exchanger.

The increasing use of air conditioning in vehicles has necessitated that such vehicles have additional air cooled heat exchangers in the form of condensers. And, with the increased use of turbochargers, there has been an increasing move towards the use of so-called intercoolers or charge air coolers which are heat exchangers that cool compressed combustion air from the turbocharger prior to its being admitted into the engine combustion chamber or chambers.

Constraints on vehicle fuel economy have led to constraints on vehicle size which in turn have led to constraints on the amount of grill area available on a car that may be occupied by the heat exchangers. Consequently, it is necessary to superimpose heat exchangers or dispose them in side by side relationship, or both. This leads to difficulty in installation during manufacture as well as to difficulty in achieving access to a given one of the heat exchanger in the event repair or other attention is required.

The present invention is directed to overcoming one or more of the above problems.

SUMMARY OF THE INVENTION

It is the principal object of the invention to provide a new and improved module of heat exchangers particularly suited for use in vehicular applications. More particularly, it is an object of the invention to provide such a module that may be easily installed during the manufacture of the vehicle and which may be easily removed and disassembled for maintenance or repair purposes following vehicle manufacture.

An exemplary embodiment of the invention achieves the foregoing object in a module including at least two heat exchangers and means mounting the heat exchangers in spaced, non-contacting relation. The mounting means include fasteners having shanks and an elongated bar of plastic material. The bar has a series of recesses along its length and each recess has a closed bottom of sufficient thickness so as to prevent the flow of fluid through the recess. The bottom is also of sufficient thinness as to be easily penetrated by the fasteners. The recesses are further oversized in relation to the size of the shanks and each fastener extends through an associated one of the heat exchangers and penetrates the bottom one of the recesses.

In one embodiment of the invention, the heat exchangers are in superimposed relation while in another, the heat exchangers are in side by side relation. In many cases, the heat exchangers are in both side by side relation and in superimposed relation.

In a highly preferred embodiment, at least one of the heat exchangers includes a side defined by an outwardly opening channel with opposed side walls. The bar is snugly received in the channel and the associated fasteners have their shanks extending through each of the side walls as well as the bar.

A preferred embodiment contemplates that the recesses are elongated in a direction transverse to the direction of elongation of the bar. One or more rows of the recesses may be provided.

Stated another way, an embodiment of the invention contemplates a pair of heat exchangers in side by side but spaced relation. Each of the heat exchangers, at their point of adjacency, has an elongated, shallow channel facing the other heat exchanger and the side walls of each channel include aligned apertured tabs with the tabs on one channel being staggered with respect to the tabs on the other channel. An elongated plastic strip is received in the channels and spaces the same. The strip has at least one row of recesses opening toward the side walls of the channels and at least some of the recesses are aligned with the apertures in the tabs. The bottom of the recesses are sufficiently thin so as to be easily penetrable by the shank of a fastener and of sufficient thickness as to prevent the flow of fluid through the interface of the heat exchangers. Fasteners having shanks of smaller size than the recess extend through the apertures of the aligned recesses to secure the heat exchangers to each other via the strip.

Another embodiment of the invention contemplates a module including first and second superimposed heat exchangers. One of the heat exchangers has opposed sides defined by outwardly opening channels and the sides of the channels include aligned apertures adapted to receive the shank of a fastener. An elongated plastic strip is disposed in each such channel and extends out of the channel in the direction away from the heat exchanger. Each such strip has at least one row of elongated recesses, at least some of which are alignable with the apertures in the channels. The recesses have bottoms as mentioned previously. Apertured legs are located on the other of the heat exchangers and space the other heat exchanger from the one heat exchanger. Additionally, the legs engage the strips in alignment with some of the recesses and in spaced relation to the channels. First fasteners penetrate the apertures in the channels and the aligned recesses to secure the strips to the one heat exchanger and second fasteners penetrate the apertures in the legs and the aligned recesses to secure the other heat exchanger to the strips and thus to the one heat exchanger.

In a highly preferred embodiment, the module may include a fan shroud which is superimposed on the other heat exchanger and has apertures aligned with the apertures in the legs. The second fasteners additionally secure the fan shroud to the strips.

Other objects and advantages will become apparent from the following specification taken in connection with the accompanying drawings.

DESCRIPTION OF THE DRAWINGS

FIG. 2 is a fragmentary, enlarged plan view of the module with parts broken away for clarity;

FIG. 3 is an enlarged, fragmentary elevation of the module;

FIG. 4 is an enlarged, fragmentary view of a strip or bar employed in the module; and FIG. 5 is an enlarged, horizontal section of the bar or strip taken approximately along the line 5—5 in FIG. 3.

DESCRIPTION OF THE PREFERRED EMBODIMENT

Figure 1:
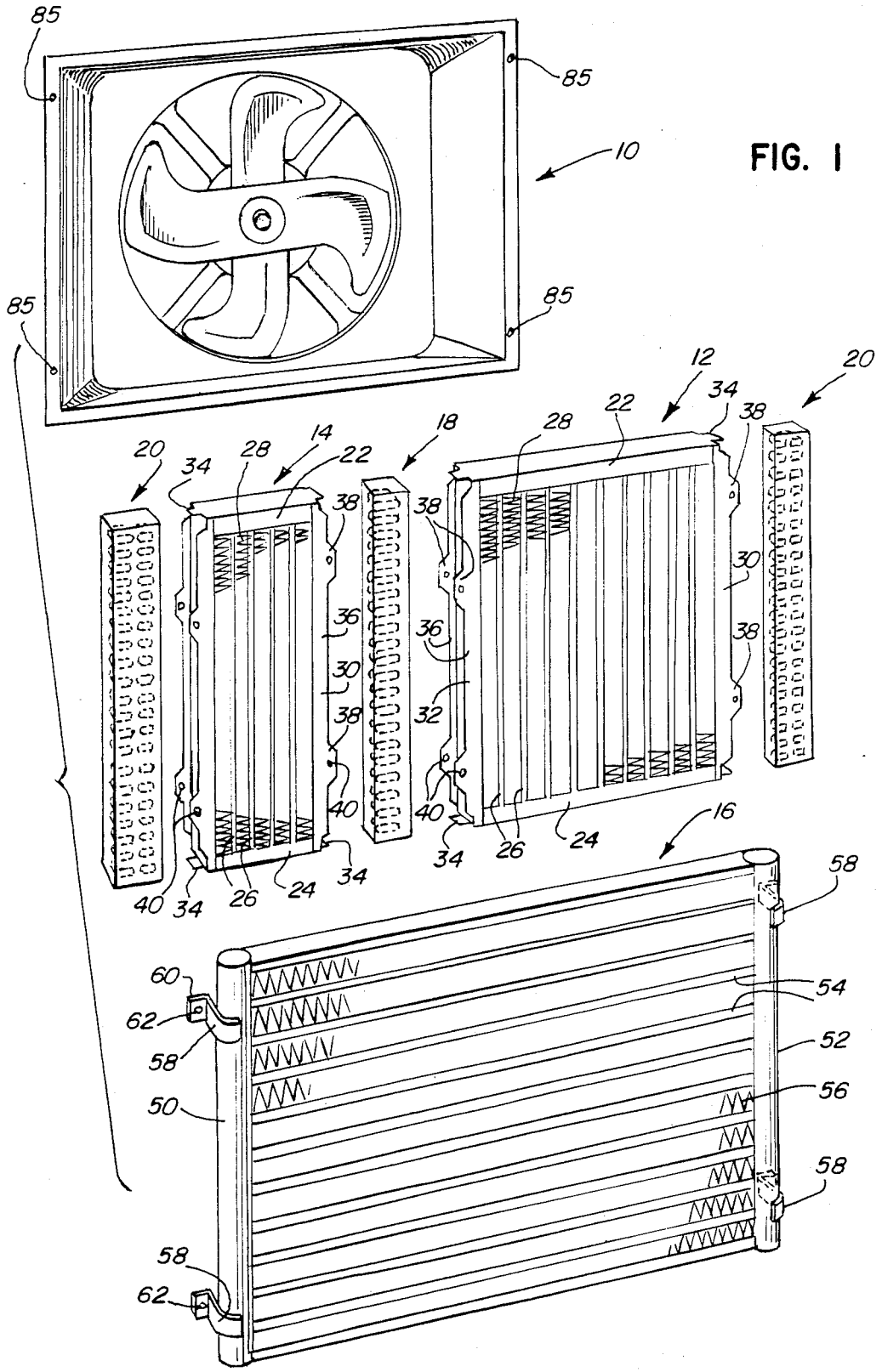
FIG. 1 is an exploded view of a heat exchanger module, including a fan shroud, made according to the invention.

An exemplary embodiment of the invention is illustrated in the drawings in the form of a heat exchanger module intended for vehicular applications. However, it is to be understood that the module may be utilized in other, non-vehicular applications where plural heat exchangers may be necessitated and it is desirable to provide for ease of manufacture and ease of maintenance or repair.

As illustrated in FIG. 1, there is illustrated a fan shroud, generally designated 10, which may or may not be part of the heat exchanger module. In the usual case, it will not be part of the module but will be fabricated so as to cooperate therewith. The module may also include a first heat exchanger, generally designated 12. In a vehicular application, the heat exchanger 12 will typically be a radiator.

A second heat exchanger, generally designated 14, is also included. The exchanger 14 in a vehicular application will conventionally be a so-called oil cooler.

The heat exchanger 14 and the heat exchanger 12 are in side by side, but spaced relation as will more fully hereinafter appear.

Superimposed on the heat exchangers 12 and 14 is a third heat exchanger, generally designated 16. As illustrated, the heat exchanger 16 may be a parallel flow condenser for use in the air conditioning system of a vehicle.

The module is completed by securing strips or bars, one form of which is generally designated 18 and another form of which is generally designated 20. The bar 18 is used in connection with fasteners (not shown) to secure the heat exchangers 12 and 14 in side by side, but spaced relation. The bars 20 are utilized to secure the heat exchanger 16 to the assembled heat exchangers 12 and 14 or, simply to the heat exchanger 12 if the oil cooler 14 is omitted. In addition, the bars 20 are employed for securing the fan shroud 10 to the assembly of heat exchangers defining the module.

Referring to the construction of the heat exchangers 12 and 14, the same are generally identical as far as the present invention is concerned, it being understood that their capacities and heat exchange capabilities may differ depending upon the application to which they are put. Each includes an upper header 22 and a lower header 24. A plurality of tubes 26 extend between the headers 22 and 24 and adjacent tubes 26 are interconnected by serpentine fins 28 as is well known.

Opposed sides of the heat exchangers 12 and 14 are defined by relatively shallow, elongated channels 30 and 32. The ends of the channels are partially closed by tabs 34 extending outwardly from the associated header 22 or 24. The bars 18 and 20 are sized to be snugly received within the channels between the tabs 34 and to extend out of the channels in the direction away from the channel bottom, that is, away from the heat exchanger of which the channel is a part.

Each side wall 36 of each of the channels 30 and 32 includes outwardly extending tabs 38 and corresponding tabs 38 have aligned apertures 40. As can be seen in FIGS. 1 and 3, the tabs 38 on the heat exchanger 12 adjacent the heat exchanger 14 are staggered with respect to the tabs 38 on the heat exchanger 14 adjacent the heat exchanger 12. As best seen in FIG. 3, this allows the heat exchangers to be disposed in close side by side relation without contact between the two. In this connection, particularly where the heat exchangers are conventionally made of metal components, contact between different ones of the heat exchangers is to be avoided to prevent the possibility of galvanic corrosion.

To this end, the bars or strips 18 and 20 are made of an insulating material. The use of an insulating material prevents the passage of galvanic currents between the adjacent or superimposed heat exchangers and thereby prevents galvanic corrosion from occurring. Any insulating material may be utilized but preferably, the same is a plastic which is not brittle and which is capable of withstanding the heat that may be imparted thereto through passage of the fluids to be cooled through the respective heat exchangers. Glass filled nylon as conventionally used in plastic tanks for radiators is but a single example of a plastic that may be used satisfactorily.

The heat exchanger 16 may include tubular headers 50 and 52 between which tubes 54 extend. Again, serpentine fins 56 extend between the tubes 54.

The header 50 mounts two spaced legs 58 each having a base 60 provided with an aperture 62. The header 52 also mounts two of the legs 58 which are provided with the apertures 62. As best seen in FIG. 2, the bases 60 of the legs 58 are so located with respect to the body of the heat exchanger 16 as to cause a space 62 to exist between the heat exchanger 16 on the one hand and the heat exchangers 12 and 14 on the other.

In the case of each of the heat exchangers 12, 14, and 16, the location of inlet and outlet ports has been omitted since it is well within the skill of the art to locate the same wherever most desirable in a given system.

Turning now to FIGS. 4 and 5, the bars 18 and 20 will be described in detail. Only the bar 20 is illustrated in these figures, it being understood that the bar 18 may be identical to the bar 20 save for the differences that will be mentioned.

Each of the bars 20 includes a plurality of oblong, deep recesses 70. The recesses 70 are aligned and are in two rows at A and B in FIG. 4. The bar 18 will have but a single one of the rows and typically will be narrower than the bar 20.

Turning to FIG. 5, each of the recesses 70 has a bottom 72. In the preferred embodiment, for ease of molding, the recesses 70 open to but a single side of the bar 20, which will be one of the sides facing a side wall 36 of one of the channels 30 and 32. In such a case, the bottom 72 will be on the opposite side of the bar 20.

In order to assure that all air flowing through the module is channeled through the areas containing the various tubes and serpentine fins for maximum heat transfer efficiency, the bottoms 72 are provided in the recesses. They are made sufficiently thick as to prevent air flow through the bars 18 and 20. That is to say, in the case of a vehicular installation, they are made of sufficient thickness as to withstand ram air pressures at the maximum speed contemplated for the vehicle.

At the same time, they are made sufficiently thin so as to be easily penetrable by the shank of a fastener as, for example, a conventional threaded fastener. In the usual case, the thickness of the bottom 72 may be as little as 2 or 3 mils.

As mentioned previously, the recesses 70 are elongated and in particular, are elongated in the direction transverse to the direction of elongation of the associated bar 18 or 20. In addition, as can be seen in FIG. 2, the same are made oversize with respect to the size of the shank of a threaded fastener that may be employed to secure the assemblage together.

The recesses are further nominally centered in alignment with the apertures 40 in the various tabs 38 as well as the apertures 62 in the legs 58. To provide maximum flexibility in the use of the bars 18 and 20, they will typically contain many more of the recesses 70 than would be required for a given installation, thus allowing the bars to be used in several differing installations that may have different alignment of the various components. Furthermore, the use of plural ones of the recesses 70 minimizes the weight of the respective bar 18 and 20 and attains a material savings as well.

In any event, headed, threaded fasteners having shanks 80 and heads 82 are passed through aligned ones of the apertures 40 in the channels 30 and 32 at the interface of the heat exchangers 12 and 14 and through the bottoms 72 to receive speed nuts 84 and thereby secure any heat exchangers 12 and 14 in side by side relation. Because the recesses 70 are elongated and oversize with respect to the size of the shanks 80 of the fasteners, considerable misalignment will be accommodated with little difficulty.

Identical fasteners having shanks 80 and heads 82 are passed through the apertures 40 in each of the channels 30 and 32 receiving one of the bars 20 to each receive a speed nut 84. This construction secures the bars 20 to the assembled heat exchangers 12 and 14. It will be observed in FIG. 2 that this set of fasteners extends through the row of recesses 70 nearest to the associated heat exchanger.

Additional fasteners having shanks 80 and heads 82 extend through apertures 85 (FIG. 1) aligned with the apertures 62 and the legs 58 and located in the periphery of the shroud 10 to receive speed nuts 84. Thus, such fasteners serve to secure the heat exchanger 16 to the heat exchangers 12 and 14 via the bars 20. They serve the additional function of mounting the heat exchanger module to the fan shroud 10 about its periphery such that all air passing through the module must pass through the same between the various tubes of the various heat exchangers in heat exchange relation with the associated fins.

From the foregoing, it will be appreciated that a module made according to the invention is readily assembled during the manufacturing process. Very little effort is required to force the various threaded fasteners through the bottoms 72 of the grooves 70 and yet such bottoms are sufficiently thick to prevent short circuiting flow of cooling air, that is, prevent the flow of cooling air in paths that are not in heat exchange relationship with the fins of various heat exchangers. The unique arrangement of the bars 18 and 20 further allows excellent compensation for lack of alignment in the various components while providing a means for economical cost for securing the components together in electrical isolation to prevent galvanic corrosion.

It will be observed that in the embodiment specifically disclosed, a total of eight fasteners interconnect three heat exchangers and a fan shroud. As a consequence, it will be appreciated that the module may be easily and readily disassembled for repair and/or maintenance of one or more of its components.

What is claimed is:

1. A heat exchanger module comprising:

at least two metallic heat exchangers; and means mounting said heat exchangers in spaced, non-contacting relation including fasteners having shanks and an elongated bar of plastic material, said bar having a series of recesses along its length, each recess having a closed bottom of sufficient thickness to prevent the flow of fluid through the recess and of sufficient thinness as to be easily penetrable by said fasteners, the recesses being oversize in relation to the size of said shanks, each said fastener extending through an associated one of said heat exchangers and penetrating the bottom of one of said recesses.

2. The heat exchanger module of claim 1 wherein said heat exchangers are in superimposed relation.

3. The heat exchanger module of claim 1 wherein said heat exchangers are in side by side relation.

4. The heat exchanger module of claim 1 wherein at least one of said heat exchangers includes a side defined by an outwardly opening channel with opposed side walls, said bar is snugly received in said channel and the associated fasteners have their shanks extending through each of said side walls as well as said bar.

5. The heat exchanger module of claim 1 wherein said recesses are elongated in a direction transverse to the direction of elongation of said bar.

6. The heat exchanger module of claim 5 wherein said recesses are aligned in a single row.

7. The heat exchanger module of claim 5 wherein said recesses are aligned in plural rows.

8. A heat exchanger module comprising:

a pair of heat exchangers in side by side, but spaced relation; each of said heat exchangers, at their point of adjacency, having an elongated, shallow channel facing the other heat exchanger, the side walls of each channel including aligned, apertured tabs with the tabs on one channel being staggered with respect to the tabs on the other channel;

an elongated plastic strip received in and spacing said channels, said strip having at least one row of recesses opening toward the side walls of said channels, at least some of said recesses aligning with the apertures in said tabs, the bottoms of said recesses being sufficiently thin so as to be easily penetrable by the shank of a fastener and of sufficient thickness as to prevent the flow of fluid through the interface of said heat exchangers; and fasteners having shanks of smaller size than said recess as extending through said apertures and the aligned recesses to secure said heat exchangers to each other via said strip.

9. The heat exchanger module of claim 8 wherein said recesses are elongated.

10. The heat exchanger module of claim 8 wherein said recesses open to a single side of said strip.

11. The heat exchanger module of claim 8 wherein the remote sides of said exchangers are provided with additional ones of said channels and additional strips in said additional channels; and further including a third heat exchanger in superimposed relation to, but spaced from said pair, said third heat exchanger including apertured legs abutting said additional strips in spaced relation to the sides of the additional channels and additional fasteners impaling said legs to said additional strips.

12. The heat exchanger module of claim 11 further including a fan shroud in superimposed relation to said heat exchangers, said additional fasteners additionally impaling said fan shroud.

13. A heat exchanger module comprising:

first and second superimposed heat exchangers;

one of said heat exchangers having opposed sides defined by outwardly opening channels, the sides of said channels including aligned apertures adapted to receive the shank of a fastener;

an elongated plastic strip disposed in each channel and extending out of the same in the direction away from the heat exchanger, each said strip having at least one row of elongated recesses, at least some of which are alignable with the apertures in said channels, the recesses having bottoms sufficiently thick as to prevent the passage of air through the strips and sufficiently thin as to be easily penetrated by a fastener;

apertured legs on the other of said heat exchanger spacing the same from said one heat exchanger and engaging said strips in alignment with some of said recesses and in spaced relation to said channels;

first fasteners penetrating said apertures in said channels and the aligned recesses to secure said strips to said one heat exchanger; and second fasteners penetrating the apertures in said legs and the aligned recesses to secure said other heat exchanger to said strips and thus to said one heat exchanger.

14. The heat exchanger module of claim 13 further including a fan shroud superimposed on said other heat exchanger and having apertures aligned with the apertures in said legs, said second fastener additionally securing said fan shroud to said strip.

* * * * *